US007175369B2

(12) United States Patent
Fomenkov et al.

(10) Patent No.: US 7,175,369 B2
(45) Date of Patent: Feb. 13, 2007

(54) GROOVED SHEET PILE AND METHOD FOR PRODUCTION THEREOF

(76) Inventors: Aleksandr Alekseevich Fomenkov, ul. Mayakovskogo, d. 19, kv. 24, Saint-Petersburg (RU) 191014; Aleksandr Julievich Lakotkin, Bolsheohtinky prospect, d. 6, kv. 70, Saint-Petersburg (RU) 195027; Vladimir Vasilievich Poterba, pos. Priladojsky, d. 1, kv. 11, Leningradskaya obl. (RU) 188696

( * ) Notice: Subject to any disclaimer, the term of this patent is extended or adjusted under 35 U.S.C. 154(b) by 0 days.

(21) Appl. No.: 10/475,910

(22) PCT Filed: Apr. 24, 2002

(86) PCT No.: PCT/RU02/00223

§ 371 (c)(1),
(2), (4) Date: Oct. 27, 2003

(87) PCT Pub. No.: WO02/086243

PCT Pub. Date: Oct. 31, 2002

(65) Prior Publication Data

US 2004/0120775 A1 Jun. 24, 2004

(30) Foreign Application Priority Data

Apr. 25, 2001 (RU) ..... 2001110815
Apr. 25, 2001 (RU) ..... 2001110969
Jul. 11, 2001 (RU) ..... 2001119077

(51) Int. Cl.
*E02D 5/08* (2006.01)

(52) U.S. Cl. ..... 405/281; 405/279; 405/277

(58) Field of Classification Search ..... 405/274, 405/276, 277–279
See application file for complete search history.

(56) References Cited

U.S. PATENT DOCUMENTS 2,128,428 A * 8/1938 Murray, Jr. ..... 405/278

(Continued)

FOREIGN PATENT DOCUMENTS

DE 2631807 6/1977

(Continued)

OTHER PUBLICATIONS

Dyad'kin S.N. et al. Erecting piers for a highway bridge over the Ob river near the city of Surgut, "Vestnik Mostostroenia," Moscow, 1997, No. 4, pp. 11-18.

(Continued)

*Primary Examiner*—Frederick L. Lagman
(74) *Attorney, Agent, or Firm*—Rader, Fishman & Grauer PLLC

(57) ABSTRACT

To simplify the production and expand the variability of structures to use, a grooved sheet pile having a trough-type body is produced by cutting a cylindrical segment (referred to as a troughlike element) (1) from a round tube along its length and fixing locking elements (2) and (3) to side edges of the troughlike element. The troughlike element (1) can be reinforced by attaching reinforcing elements (4) thereto and/or providing annular elements (15), (16). The troughlike element (1) has a section made of material of higher strength and/or corrosion-resistant and/or thickened material. The troughlike elements (1) can be arranged in parallel and fixed to each other to make a panel.

4 Claims, 5 Drawing Sheets

U.S. PATENT DOCUMENTS

| | | | | | |
|---|---|---|---|---|---|
| 3,429,126 | A | * | 2/1969 | Wey | 405/267 |
| 3,822,557 | A | * | 7/1974 | Frederick | 405/248 |
| 3,999,392 | A | * | 12/1976 | Fukushima et al. | 405/281 |
| 4,917,543 | A | * | 4/1990 | Cole et al. | 405/262 |
| 5,006,687 | A | * | 4/1991 | Fujita et al. | 219/121.59 |
| 5,145,287 | A | * | 9/1992 | Hooper et al. | 405/262 |
| 5,333,971 | A | | 8/1994 | Lewis | |
| 5,388,931 | A | * | 2/1995 | Carlson | 405/274 |
| 5,437,138 | A | * | 8/1995 | Tuohey et al. | 52/741.1 |
| 5,447,393 | A | * | 9/1995 | Yeates et al. | 405/276 |
| 5,902,074 | A | * | 5/1999 | Berkley et al. | 405/274 |

FOREIGN PATENT DOCUMENTS

| | | | | |
|---|---|---|---|---|
| JP | 55136319 | * | 10/1980 | 405/277 |
| JP | 1010817 A | | 1/1989 | |
| RU | 1731905 | | 5/1992 | |
| SU | 7292 | | 12/1928 | |
| SU | 755945 | | 8/1980 | |
| SU | 1477842 | | 5/1989 | |
| WO | WO92019819 | | 11/1992 | |

OTHER PUBLICATIONS

English Abstract for RU1 731 905.
English Abstract for SU1 477 842.
English Abstract for DE2 631 807.
English Abstract for SU755 945.
English Abstract for WO92/19819.
English Abstract for SU7292.

* cited by examiner

GROOVED SHEET PILE AND METHOD FOR PRODUCTION THEREOF

FIELD OF INVENTION

The present invention relates to the field of construction and concerns more specifically metallic grooved sheet piles intended to erect sheet-pile walls in the ground.

PRIOR ART

Known is a method for producing grooved sheet piles by hot rolling, during which rolling the pile body together with locking elements are obtained. Such a technique makes it possible to fabricate a known hot-rolled grooved pile that contains a wall and side flanges adjoining this wall, said flanges being provided with locking elements made in the form of hooks (see USSR Author's Certificate No. 1 731 905, E02D 5/00, E02D 5/02, B21 B 1/08, published in 1992). Free ends of the side flanges are spaced apart for a distance exceeding the wall width. The inner surface of the lock base is made inclined toward the point of bending.

The hot rolling technique is also used to fabricate another known grooved pile that comprises, here again, a wall and side flanges with locking elements adjoining this wall (see USSR Author's Certificate No. 1 477 842, E02D 5/00, published in 1989). Free ends of the side flanges are spaced apart for a distance exceeding the wall width.

Furthermore, the hot rolling technique have been used to obtain a known grooved pile having a trough-shaped body and locking elements molded from a metal sheet of regular thickness (see German Accepted Application No. 2 631 807, E02D 5/04, published in 1977). The body is curved along the arc of a circle and coupled to locking elements that are formed by flanging the lateral parts of said body and bending the parts thus flanged so as to obtain hooks.

The same hot rolling technique has been adopted to manufacture a known enlarged grooved pile comprising a wall with a central portion and two end portions, flanges coupled to said end portions of the wall, and locking elements formed at free ends of the flanges (see USSR Author's Certificate No. 755 945, E02D 5/04, published in 1980). The flanges are directed oppositely with respect to the wall, perpendicular to its central portion. One of the locking elements is made in the form of a trapezoidal projection and another locking element, in the form of a trapezoidal recess.

Besides, the hot rolling technique has been used to fabricate a known enlarged grooved pile comprising a panel and locking elements molded together with said panel (see International Application WO92/19819, E02D 5/04, E02D 7/14, published in 1992). The panel and the locking elements are obtained from a same metal sheet of regular thickness. The panel has the form of a plurality of parallel projections with trapezoidal cross-section. The locking elements are formed by flanging panel's side parts so as to obtain hooks. Both panel and locking elements are molded at the same time in the course of hot rolling.

Known is also a double-unit grooved pile consisting of two trough-shaped piles joined together, each single pile having two locking elements (see USSR Patent NO. 7292, Cl. 37B, E02D 5/02, published in 1928). Such grooved piles are fabricated using a hot rolling method, the body and the locking elements being formed simultaneously. At one lateral face of the body there is provided a thickened edge and at another face, a bent-out flange. The female locking element has a Π-shaped cross-section, while the male locking element is adapted to be placed inside the cavity of said female element. The two trough-shaped grooved piles are joined together by inserting the male element of one of the piles into the female locking element of the other pile. Upon completion of the joining operation, the locking elements are squeezed and deformed to form a nondetachable joint.

This method of producing a grooved pile by hot rolling of the body together with the locking elements suffer of a drawback consisting in its complexity, taking into account that in order to implement this method, a dedicated multiroll mill is needed provided with rolls of a complex shape.

There is known finally a method of producing grooved piles that is simplified as compared with the above-described embodiment, this improved method comprising the steps of separate fabrication of a trough-shaped body and locking elements, followed by fixing said locking elements to the side edges of said body. This method is usable to manufacture a known grooved pile comprising a body and locking elements secured thereto (see U.S. Pat. No. 5,333,971, Nat. Cl. 405-281, EO2D 5/00, EO2D 7/20, published in 1994). The body is fabricated by hot rolling of a sheet of regular thickness. It has a flat central wall and two flat side walls adjoining at an angle said central wall.

It is possible in this case to use more simple rolls of the rolling mill used to obtain the trough-shaped body. Nevertheless, the fabrication of this pile remains still complex enough owing to the necessity to have a special rolling mill.

The disadvantage common to all the piles described above consists in the complexity of their fabrication and the difficulty to use them due to a limited variability of their structural implementation.

BRIEF DESCRIPTION OF THE INVENTION

The object of the present invention is to simplify the process of fabrication of grooved sheet piles while extending at the same time the variability of their design.

To achieve the above technical result, a method of producing a grooved sheet pile is provided, comprising the steps of separate fabricating a trough-shaped body and locking elements and characterized in that the body is produced by cutting, from a round tube, a cylindrical segment, hereinafter referred to as a troughlike element, a troughlike element extending along the length thereof. Each locking element is fixed to the side edge of the troughlike element thus cut or in the vicinity of this side edge.

The troughlike element may be cut together with an annular section of the tube, which section adjoins said troughlike element or is located within the middle part thereof.

The cut troughlike element may be reinforced by securing element reinforcing members to it or by fitting such element reinforcing members into this element.

According to a method of producing a grooved sheet pile, comprising the steps of fabrication of a panel and locking elements, the process of fabricating said panel comprises cutting, from a round tube, troughlike elements extending along the length thereof. Then the elements thus cut are arranged in a row in a parallel position with respect to each other and rigidly fixed together. Each locking element is fixed to the side edge of the panel or in the vicinity of this side edge.

In a grooved sheet pile of the invention, comprising a trough-shaped body and locking elements, the body is cut from a round tube in the form of a troughlike element extending along the length of the tube and having a radial angle not exceeding 180°. Each locking element is made in the form of a separate piece fixed to the side edge of the troughlike element or in the vicinity of this side edge.

The grooved sheet pile may be provided with a strap fixed to the middle part of the troughlike element thus forming a lens-shaped air cavity extending along the length of said troughlike element, and/or provided with fixing elements rigidly coupling together the side edges of the troughlike element, and/or provided with longitudinal stiffening ribs adjoining the side edges of the troughlike element.

Along the length of the grooved pile, the body wall may have varying thickness and/or sections made of different materials.

A part of the body may be in the form of a ring cut from a round tube together with the troughlike element cut therefrom.

In an enlarged grooved pile, comprising a panel and locking elements, the panel is composed of elongated troughlike elements with a radial angle not exceeding 180°, which are cut from tubes and arranged in a row in a parallel position with respect to each other. The troughlike elements are rigidly fixed together. Each locking element is made in the form of a separate piece and fixed to the side edge of the panel or in the vicinity of this side edge.

An enlarged grooved pile may comprise an interelement reinforcing member mounted between the troughlike elements or put onto the adjacent side edges of the troughlike elements, and/or fixing elements rigidly coupling together the side edges of the troughlike elements, and/or a strap fixed to the middle part of the troughlike element, and/or faceplates, and/or longitudinal stiffening ribs adjoining the side edges of the panel.

The panel wall may have, along the length of the grooved pile, a varying thickness and/or sections made of different materials.

The panel elements may be in part in the form of rings cut from round tubes together with the troughlike elements cut therefrom.

The above-listed methods allow the fabrication of grooved sheet piles by using finished tubes as raw material for obtaining the body, thus eliminating the necessity for rolling mills specially designed to hot-roll such piles. The external and internal straps, the fixing elements, the external and internal faceplates, as well as the stiffening ribs contribute to increasing the mechanical resistance of a grooved pile and its longitudinal stability.

Thanks to the great variety of structural implementation of the grooved sheet piles proposed herein, taking also into consideration a wide range of available ready-made tubes of different cross-section and different material, that are used to fabricate such piles, it becomes possible to easily produce a very broad range of grooved piles designed for different ground situations and service conditions, while ensuring at the same time their required strength and high operating reliability.

BRIEF DESCRIPTION OF DRAWINGS

The advantages of the proposed set of embodiments of the invention will become more apparent from the ensuing detailed description below with the reference to the accompanying drawings in which.

DETAILED DESCRIPTION

Figure 14:
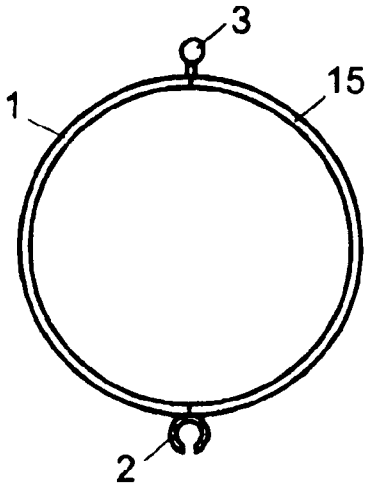
FIG. 14 shows, in a front view, a grooved sheet pile having a troughlike element and a ring of regular width.
Figure 16:
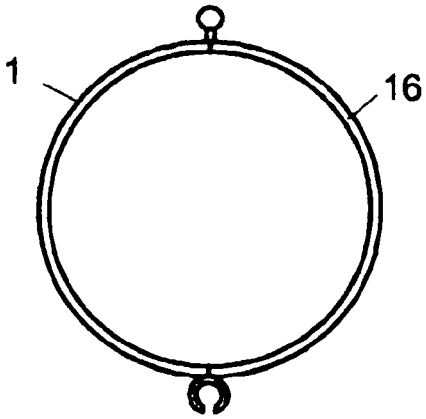
FIG. 16 shows, in a front view, a grooved sheet pile having a troughlike element and a ring of varying width.
Figure 15:
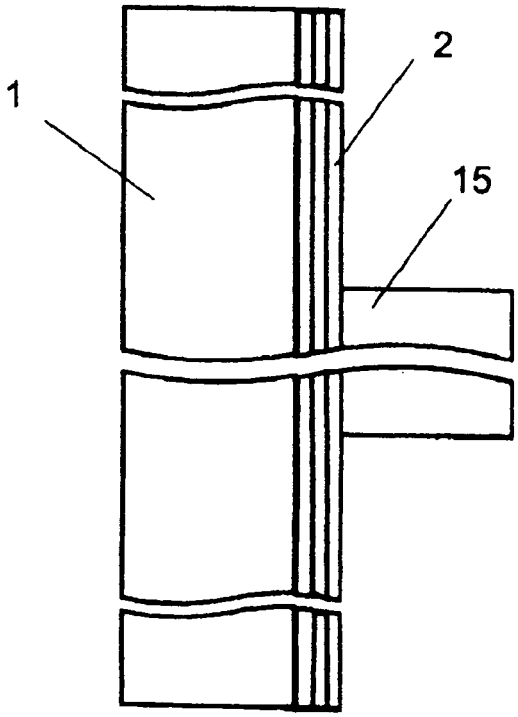
FIG. 15 shows, in a bottom view, a grooved sheet pile having a troughlike element and a ring of regular width.
Figure 17:
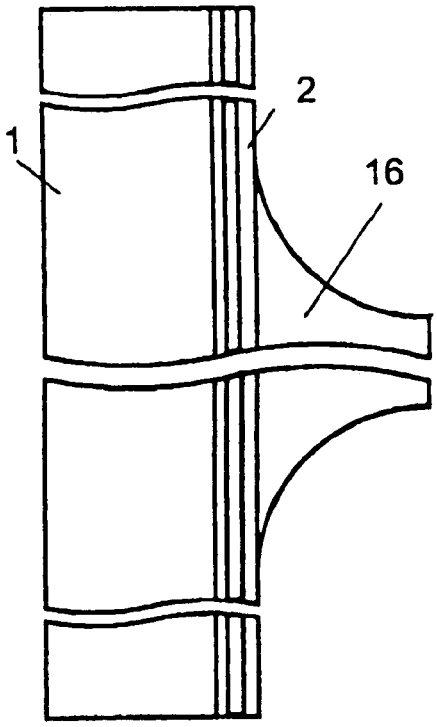
FIG. 17 shows, in a bottom view, a grooved sheet pile having a troughlike element and a ring of varying width.
Figure 18:
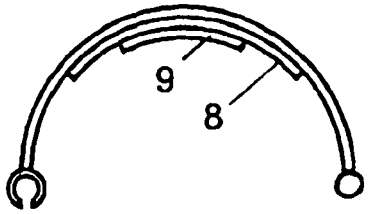
FIG. 18 shows, in a front view, a grooved sheet pile having a troughlike element and internal faceplates.
Figure 19:
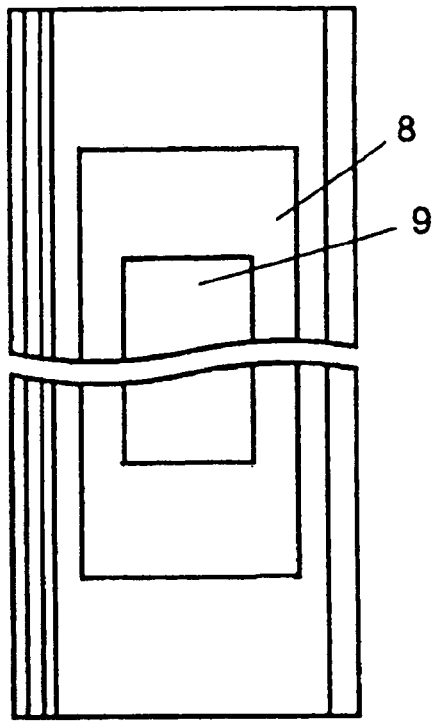
FIG. 19 shows, in a bottom view, a grooved sheet pile having a troughlike element and internal faceplates.
Figure 21:
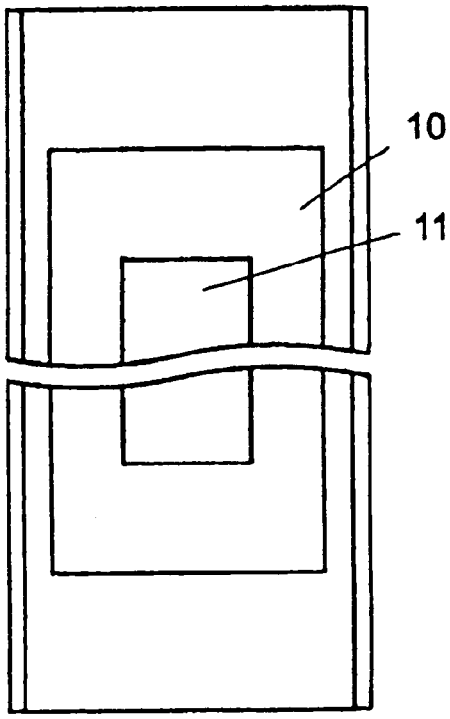
FIG. 21 shows, in a top view, a grooved sheet pile having a troughlike element and external faceplates.
Figure 20:
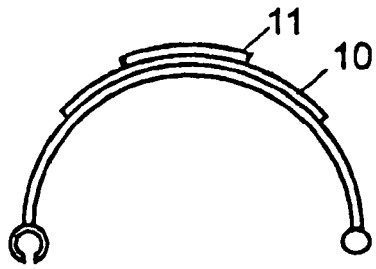
FIG. 20 shows, in a front view, a grooved sheet pile having a troughlike element and external faceplates.
Figure 22:
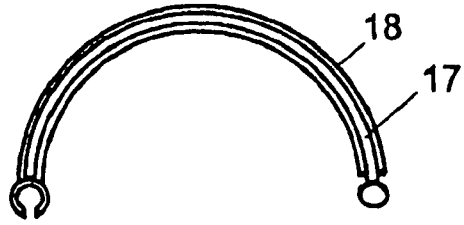
FIG. 22 shows, in a front view, a grooved sheet pile having a troughlike element of varying thickness.
Figure 23:
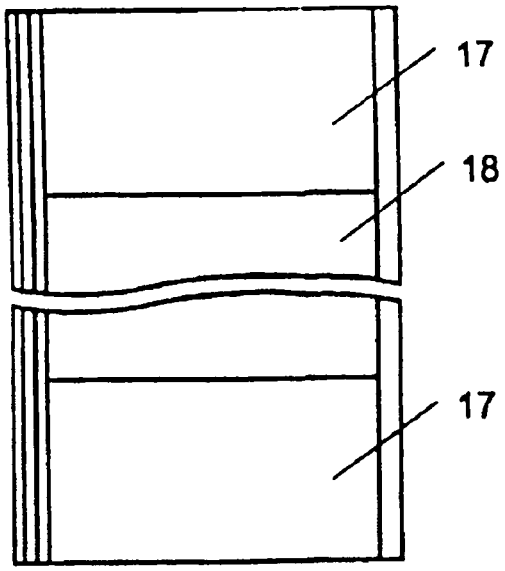
FIG. 23 shows, in a bottom view, a grooved sheet pile having a troughlike element of varying thickness.
Figure 34:
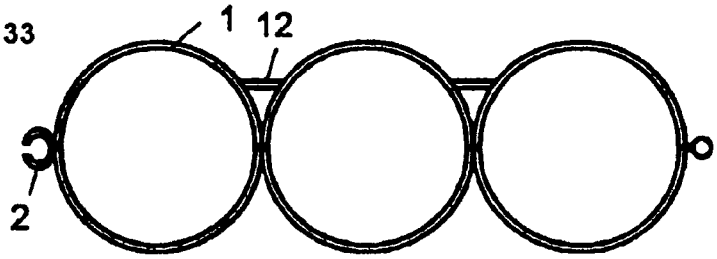
FIG. 34 shows, in a front view, a grooved sheet pile having a panel composed of three troughlike elements, a ring of varying width and a flat interelement reinforcing member.
Figure 35:
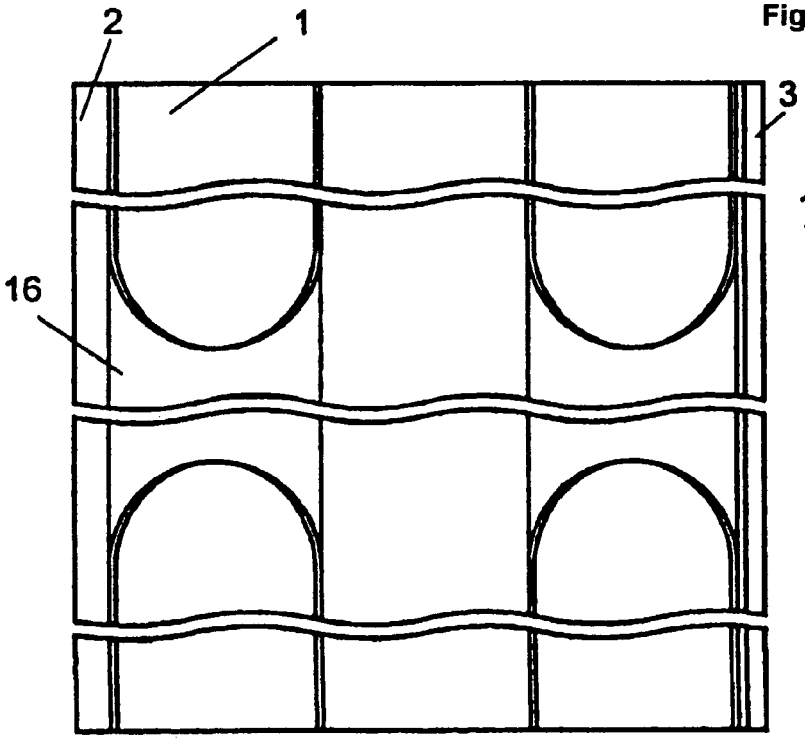
FIG. 35 shows, in a bottom view, a grooved sheet pile having a panel composed of three troughlike elements, a ring of varying width and a flat interelement reinforcing member.
Figure 36:
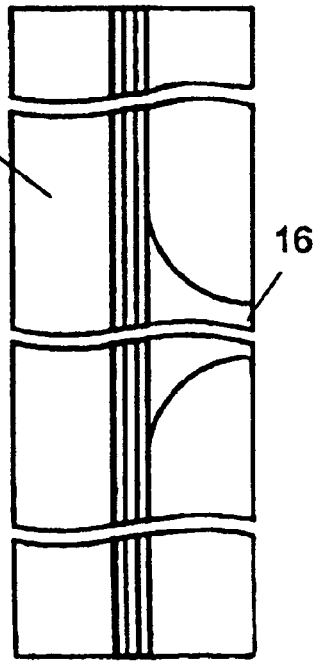
FIG. 36 shows, in a side view, a grooved sheet pile having a panel composed of three troughlike elements, a ring of varying width and a flat interelement reinforcing member.

A grooved sheet pile according to the invention comprises a troughlike element 1, or a plurality of troughlike elements 1, a female locking element 2 and a male locking element 3. In accordance with various structural embodiments, there may be either fixing elements 4, or internal strap 5, or external strap 6, or stiffening ribs 7, or internal faceplates 8, 9, or external faceplates 10, 11, or a flat reinforcing member 12, or a semi-circular reinforcing member 13, or finally a circular reinforcing member 14 fixed to the troughlike element 1, the elements 4–11 being element reinforcing elements, and elements 12–14 being interelement reinforcing elements. The troughlike element 1 shown in FIGS. 14 and 15 is cut from a round tube (not shown) together with a ring 15 of regular width, whereas that of FIGS. 16 and 17 is cut together with a ring 16 of varying width. A grooved sheet pile shown in FIGS. 22 and 23 is composed of two sections 17 of small thickness and a section 18 of greater thickness interposed between them and made of a corrosion-resistant material or of a material of enhanced strength as compared to that used for the sections 17. A grooved sheet pile shown in FIGS. 34 to 36 is composed of three troughlike elements 1 cut together with rings 16 of varying width.

Figure 1:
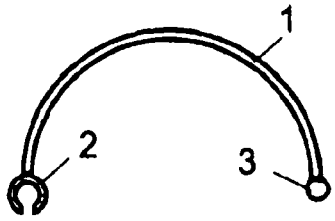
FIG. 1 shows, in a front view, a grooved sheet pile having a troughlike element.
Figure 2:
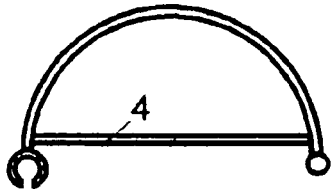
FIG. 2 shows, in a front view, a grooved sheet pile having a troughlike element and fixing elements.
Figure 4:
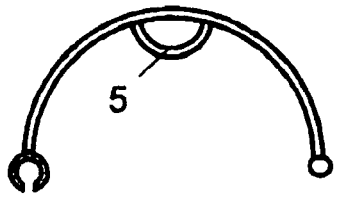
FIG. 4 shows, in a front view, a grooved sheet pile having a troughlike element and an internal strap.
Figure 3:
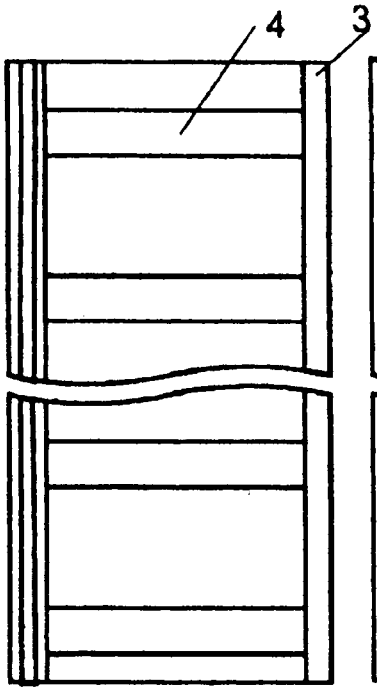
FIG. 3 shows, in a bottom view, a grooved sheet pile having a troughlike element and fixing elements.
Figure 5:
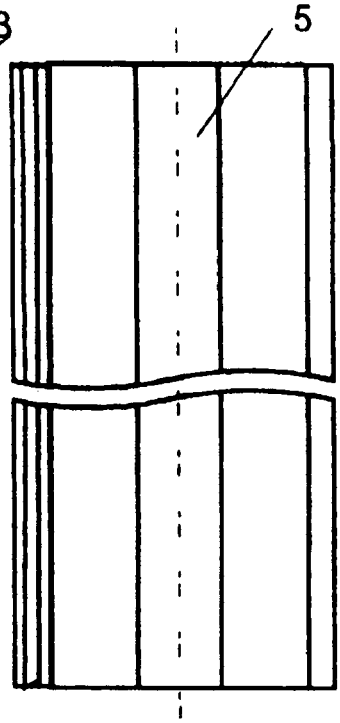
FIG. 5 shows, in a bottom view, a grooved sheet pile having a troughlike element and an internal strap.
Figure 6:
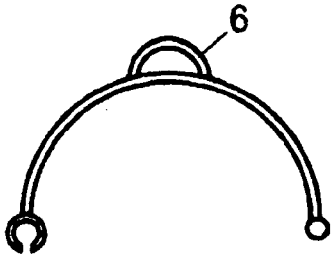
FIG. 6 shows, in a front view, a grooved sheet pile having a troughlike element and an external strap.
Figure 7:
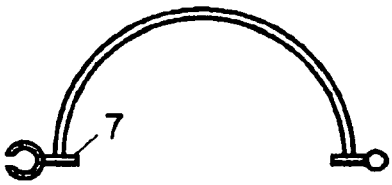
FIG. 7 shows, in a front view, a grooved sheet pile having a troughlike element and stiffening ribs.
Figure 8:
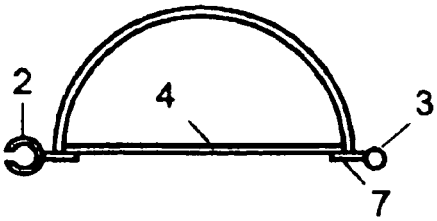
FIG. 8 shows, in a front view, a grooved sheet pile having a troughlike element, fixing elements and stiffening ribs.
Figure 9:
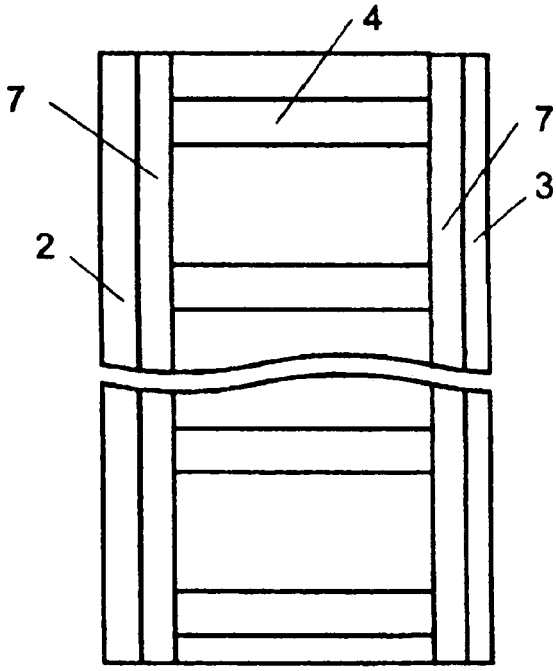
FIG. 9 shows, in a bottom view, a grooved sheet pile having a troughlike element, fixing elements and stiffening ribs.
Figure 10:
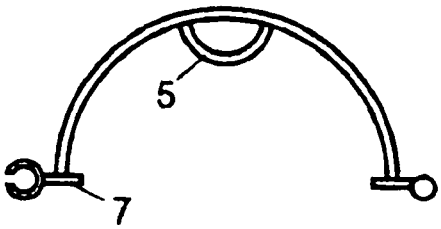
FIG. 10 shows, in a front view, a grooved sheet pile having a troughlike element, an internal strap and stiffening ribs.
Figure 11:
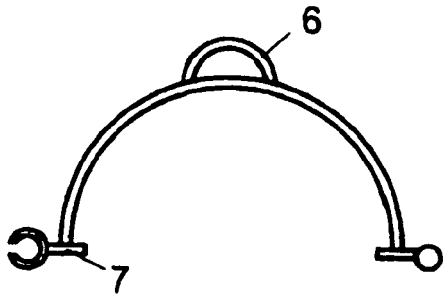
FIG. 11 shows, in a front view, a grooved sheet pile having a troughlike element, an external strap and stiffening ribs.
Figure 12:
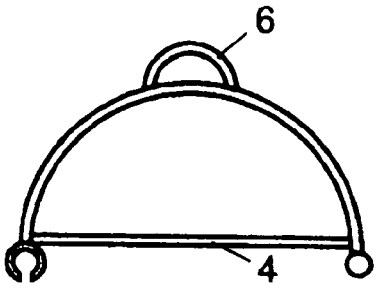
FIG. 12 shows, in a front view, a grooved sheet pile having a troughlike element, an external strap and fixing elements.
Figure 13:
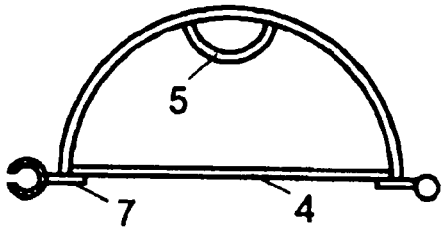
FIG. 13 shows, in a front view, a grooved sheet pile having a troughlike element, an internal strap and fixing elements.

A grooved pile having a trough-shaped body is fabricated by cutting, from a round tube, a troughlike element 1 extending along the length thereof and welding locking elements 2 and 3 to this troughlike element. In favorable ground conditions and under insignificant loads supported by the sheet-pile wall, the grooved pile may be produced in a simplified form, without using reinforcing members, as illustrated in FIG. 1. In more severe operating conditions, however, it is necessary to weld to the troughlike element 1 either appropriate fixing elements 4, or an internal strap 5, or an external strap 6, or internal faceplates 8 and 9, or external faceplates 10 and 11, or stiffening ribs 7, or various combinations of the above-mentioned pieces, as demonstrated in FIGS. 2 to 13 and 18 to 21. The troughlike element 1 may be cut from a tube together with an annular section of this tube in the form of a ring 15 of regular width or a ring 16 of varying width (see FIGS. 14 to 17). These rings 15 and 16 play the role of troughlike element reinforcing members intended to relieve the most stressed portions of the grooved pile, thereby eliminating the need for using troughlike element reinforcing members 4 to 11. In order to reinforce the most stressed part of the grooved pile and/or to enhance its corrosion resistance, its body may be made composed of sections of troughlike elements welded together, of which at least one has an increased wall thickness or is made of a corrosion-resistant and/or a stronger material (FIGS. 22 and 23).

Figure 24:
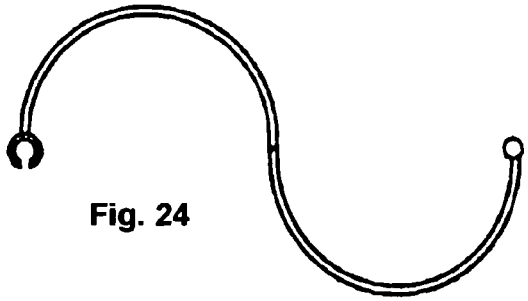
FIG. 24 shows, in a front view, a grooved sheet pile having two troughlike elements.
Figure 25:
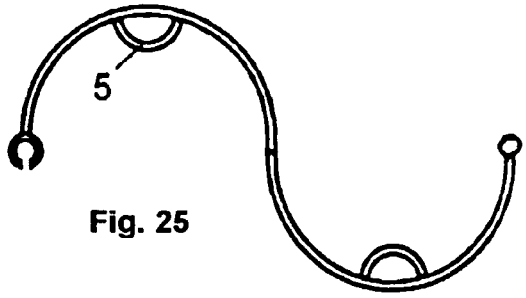
FIG. 25 shows, in a front view, a grooved sheet pile having a panel composed of two troughlike elements, and straps.
Figure 26:
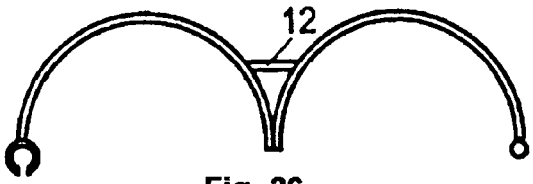
FIG. 26 shows, in a front view, a grooved sheet pile having a panel composed of two troughlike elements, and a flat interelement reinforcing member.
Figure 27:
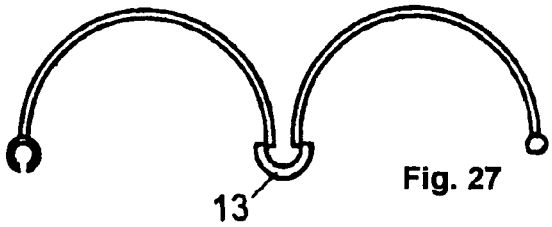
FIG. 27 shows, in a front view, a grooved sheet pile having a panel composed of two troughlike elements, and a semi-circular interelement reinforcing member superimposed on the adjacent edges of the troughlike elements.
Figure 28:
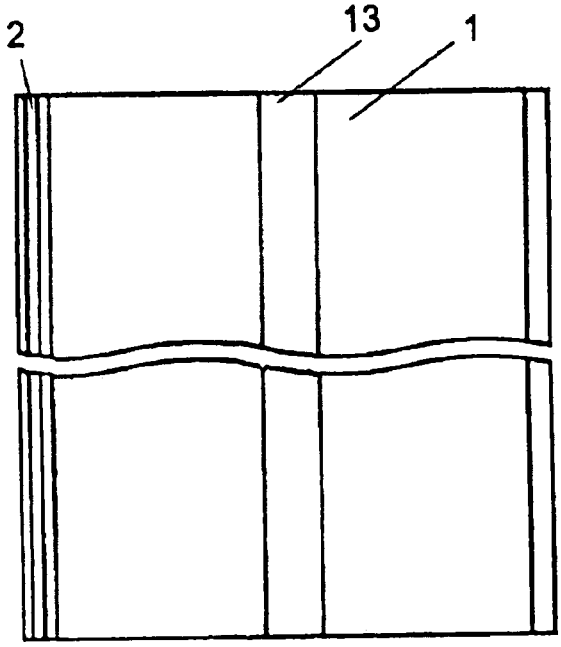
FIG. 28 shows, in a bottom view, a grooved sheet pile having a panel composed of two troughlike elements, and a semi-circular interelement reinforcing member superimposed on the adjacent edges of the troughlike elements.
Figure 29:
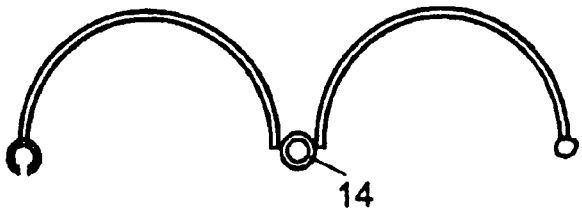
FIG. 29 shows, in a front view, a grooved sheet pile having a panel composed of two troughlike elements, and a circular interelement reinforcing member mounted between the cylindrical troughlike elements.
Figure 30:
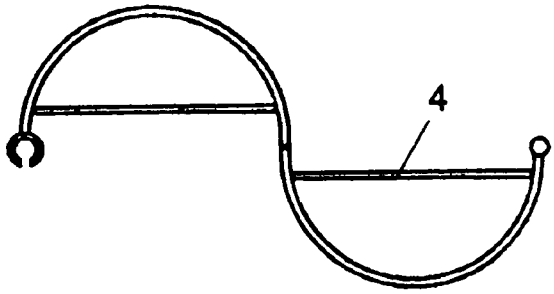
FIG. 30 shows, in a front view, a grooved sheet pile having a panel composed of two troughlike elements, and fixing elements.
Figure 31:
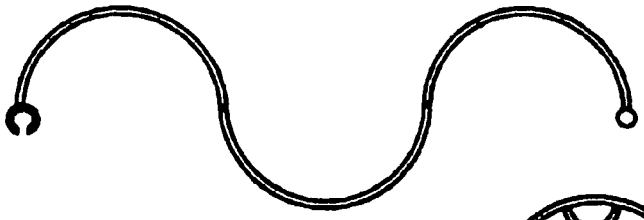
FIG. 31 shows, in a front view, a grooved sheet pile having a panel composed of three troughlike elements.
Figure 32:
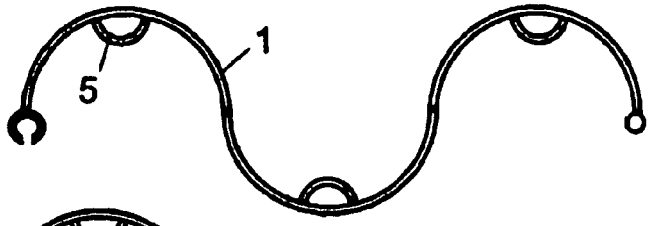
FIG. 32 shows, in a front view, a grooved sheet pile having a panel composed of three troughlike elements, and straps.
Figure 33:
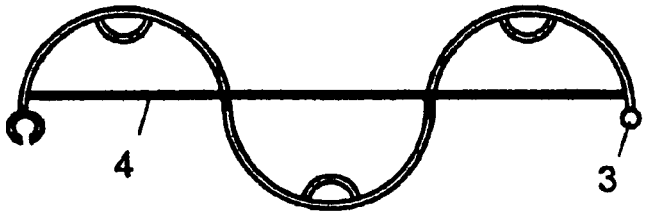
FIG. 33 shows, in a front view, a grooved sheet pile having a panel composed of three troughlike elements, and fixing elements.

The above-described techniques for producing a grooved sheet pile having a trough-shaped body may be used also to obtain an enlarged pile whose body is composed of two or more troughlike elements 1 arranged in a row as shown in FIG. 24 to 36. In case where such enlarged piles are intended to work in sufficiently light conditions, the troughlike elements 1 are joined as shown in FIGS. 24 and 31. On the other hand, when using an enlarged pile in more severe conditions, it becomes necessary to weld to the troughlike elements of such piles either fixing elements 4, or an internal strap 5, or an external strap 6, or internal faceplates 8 and 9, or external faceplates 10 and 11, or stiffening ribs 7, or interelement reinforcing members 12 to 14, or various combinations of these pieces, as shown in FIGS. 25 to 30 and 32 to 34.

The preferred embodiments as described hereinabove and illustrated in the attached drawings are only given as examples intended to make clear the essence of the invention. It is quite evident therefore that other embodiments thereof are possible and various modifications may be introduced thereto without departing from the scope of the claims below.

BEST EMBODIMENTS OF THE INVENTION

In order to fabricate a grooved sheet pile having a trough-shaped body, a finished tube is selected from the range of batch-produced tubes used e.g. to lay gas- and oil pipelines, water supply and heating mains etc. having diameters of 630 to 1,420 mm and wall thickness of 9 to 20 mm. A troughlike element 1 is cut from such a tube, having a radial angle of 180° and fitted with a ring 16 of varying width, after which locking elements 2 and 3 are welded thereto.

In case an enlarged grooved sheet pile is needed, two or more troughlike elements 1 will be used provided with rings 16 of varying width, which elements are cut from tubes having diameters of 530 to 820 mm and wall thickness of 8 to 14 mm. The elements thus cut are then arranged in a row and welded together. The final step of producing the enlarged grooved pile includes welding locking elements to side faces of the panel as shown in FIGS. 34 to 36.

INDUSTRIAL APPLICABILITY

The proposed grooved sheet piles can be used primarily in constructing and renovating hydraulic structures for numerous purposes and in erecting retaining walls for pits or other temporary structures.

What is claimed is:

1. A method of producing a grooved sheet pile, comprising the steps of separately fabricating a trough-shaped body and locking elements, wherein said body is produced by cutting a troughlike element from a round tube along the length of the tube, and wherein each of said locking elements is fixed to a side edge of the troughlike element thus cut or in the vicinity of said side edge.

2. The method according to claim 1, wherein said troughlike element is cut out of said tube together with an annular element thereof, said annular element adjoining said troughlike element or being located in a middle part thereof.

3. The method according to claim 1, wherein said troughlike element is reinforced by reinforcing elements secured thereto or fit therein.

4. A method of producing a grooved sheet pile, comprising the steps of fabricating a panel and locking elements, wherein said fabricating said panel includes cutting troughlike elements from a round tube along the length of the tube, arranging the troughlike elements thus cut in a row in a parallel position with respect to each other and rigidly fixing adjacent troughlike elements together, each of said locking elements being fixed to a side edge of said panel or in the vicinity of said side edge.

* * * * *